US007404443B2

(12) United States Patent
Patton et al.

(10) Patent No.: US 7,404,443 B2
(45) Date of Patent: Jul. 29, 2008

(54) COMPENSATION SYSTEM FOR A JACKING FRAME

(75) Inventors: Bart Patton, Sugar Land, TX (US); Yarom Polsky, Albuquerque, NM (US)

(73) Assignee: Schlumberger Technology Corporation, Sugar Land, TX (US)

( * ) Notice: Subject to any disclaimer, the term of this patent is extended or adjusted under 35 U.S.C. 154(b) by 154 days.

(21) Appl. No.: 11/315,814

(22) Filed: Dec. 22, 2005

(65) Prior Publication Data

US 2007/0089882 A1 Apr. 26, 2007

Related U.S. Application Data

(60) Provisional application No. 60/729,382, filed on Oct. 21, 2005.

(51) Int. Cl.
*E21B 7/12* (2006.01)

(52) U.S. Cl. ..... 166/355; 166/77.1; 166/77.2

(58) Field of Classification Search ..... 166/77.1–77.3, 166/350–355, 367; 405/158, 195.1, 196, 405/224, 224.2–224.4
See application file for complete search history.

(56) References Cited

U.S. PATENT DOCUMENTS

| | | | | |
|---|---|---|---|---|
| 2,966,221 | A | 12/1960 | Kinney | |
| 3,653,636 | A | 4/1972 | Burrell | |
| 3,714,995 | A * | 2/1973 | Hanes et al. | 175/5 |
| 3,721,293 | A * | 3/1973 | Ahlstone et al. | 166/355 |
| 3,793,835 | A * | 2/1974 | Larralde | 60/413 |
| 3,841,607 | A * | 10/1974 | Larralde et al. | 254/392 |
| 3,871,622 | A * | 3/1975 | Larralde et al. | 254/392 |
| 3,946,559 | A * | 3/1976 | Stevenson | 60/413 |
| 4,121,806 | A | 10/1978 | Iato et al. | |
| 4,222,341 | A * | 9/1980 | Larsen et al. | 114/264 |
| 4,421,173 | A | 12/1983 | Beakley et al. | |
| 4,487,150 | A * | 12/1984 | Shanks | 114/264 |
| 4,962,817 | A * | 10/1990 | Jones et al. | 175/5 |
| 5,069,488 | A * | 12/1991 | Freyer et al. | 285/302 |
| 5,209,302 | A * | 5/1993 | Robichaux et al. | 166/355 |
| 6,000,480 | A * | 12/1999 | Eik | 175/8 |
| 6,276,454 | B1 * | 8/2001 | Fontana et al. | 166/343 |
| 6,691,775 | B2 * | 2/2004 | Headworth | 166/77.2 |
| 6,929,071 | B2 * | 8/2005 | Moncus et al. | 166/355 |
| 7,063,159 | B2 * | 6/2006 | Patton et al. | 166/355 |
| 7,231,981 | B2 * | 6/2007 | Moe et al. | 166/355 |
| 2003/0221822 | A1 * | 12/2003 | Polsky et al. | 166/85.4 |
| 2005/0211430 | A1 * | 9/2005 | Patton et al. | 166/77.2 |
| 2007/0089884 | A1 * | 4/2007 | Patton | 166/355 |

FOREIGN PATENT DOCUMENTS

| | | |
|---|---|---|
| GB | 2334048 | 8/1999 |

FOREIGN PATENT DOCUMENTS

| | | |
|---|---|---|
| GB | 2343466 | 5/2000 |
| GB | 2349660 | 11/2000 |
| GB | 2399838 | 9/2004 |

* cited by examiner

*Primary Examiner*—Thomas A Beach
*Assistant Examiner*—Matthew R Buck
(74) *Attorney, Agent, or Firm*—Rodney Warfford; David Cate; Robin Nava

(57) ABSTRACT

An offshore oil well platform assembly is provided that includes a jacking frame, which supports a coiled tubing injector, which in turn is connected to a wellhead during a coiled tubing operation; and a compensation system. The compensation system includes a force measurement system which measures forces applied to the wellhead; a force delivery system, which provides a compensating force to counteract at least a portion of the measured forces on the wellhead; and a control system which receives signals from the force measurement system indicative of the measured forces, and operates the force delivery system based on the measured forces.

20 Claims, 3 Drawing Sheets

COMPENSATION SYSTEM FOR A JACKING FRAME

CROSS-REFERENCE TO RELATED APPLICATION

This application claims priority under 35 U.S.C. § 119(e) to U.S. Provisional Application Ser. No. 60/729,382, filed on Oct. 21, 2005, which is incorporated herein by reference. This application is also a Continuation in Part of U.S. patent application Ser. No. 10/809,256, filed on Mar. 25, 2004.

FIELD OF THE INVENTION

The present invention relates generally to a compensation system for a jacking frame, and in one embodiment to such a compensation system which is responsive to rapid onset loading on a wellhead related to movement by platform installed equipment.

BACKGROUND

Coiled tubing operations on floating offshore drilling platforms typically require a motion compensated jacking frame. A motion compensated jacking frame supports a coiled tubing injector during a coiled tubing operation and includes a motion compensation system to offset potentially damaging relative motion between the coiled tubing injector, which is fixed to the platform, and the wellhead, which is fixed to the seafloor. As such, waves, currents and other external forces can cause damaging relative movements between the coiled tubing injector and the wellhead. Motion compensation systems protect the wellhead by reducing the load transferred from the coiled tubing injector to the wellhead when such relative motions occur.

However, during a coiled tubing operation the coiled tubing may become "hung up" or "stuck" in the well for many various reasons. This results in the transfer of a large load or a rapid load change on the wellhead as the coiled tubing injector is pulled down onto the wellhead in reaction to the "sticking" of the coiled tubing string in the well. Conventional passive coiled tubing motion compensation systems do not have the capability to react to such large rapid load changes. Instead, such systems are designed to detect relative motions between the coiled tubing injector and the wellhead and react by applying a relatively constant accumulator spring rate in response thereto.

Passive compensation systems provide some degree of force isolation between the stationary and moving components by use of what can be analogized to a low frequency dampener. Passive compensation systems typically include cylinders in combination with a compressible fluid circuit, such as nitrogen bladder hydraulic accumulators or direct air pressurization, to allow cylinder displacement with only moderate variation in applied force.

When applied to coiled tubing operations, the coiled tubing injector is placed on a structure that is supported by the aforementioned cylinders on one end and connected to a structure anchored to the floating platform on the other end. When a relative motion occurs between the wellhead and the platform (and hence the coiled tubing injector supported on the platform), the cylinders displace resulting in a moderate change in the force of the supported load on the injector (and hence the load on the wellhead.)

Typically, nitrogen charged accumulators are connected to the cylinders to provide a relatively constant hydraulic pressure to the cylinders. The accumulator nitrogen charge pressure is adjusted to maintain a relatively constant force throughout the cylinder stroke. Such an arrangement is adequate when the load on the wellhead remains constant, however, in most coiled tubing operations the load on the wellhead varies anytime the coiled tubing string weight is increased or decreased due to the addition or removal of coiled tubing from the well.

As such, operator adjustment of the cylinder stiffness coefficient is typically required to account for this dynamic loading of the wellhead. That is, when the load on the wellhead is increased, the cylinder stiffness coefficient may be manually increased by adding nitrogen support bottles to the system to increase the nitrogen pre-charge in the accumulators; and when the load on the wellhead is decreased, the cylinder stiffness coefficient may be manually decreased by bleeding off some of the nitrogen pre-charge pressure to maintain a desired compensating force. Accordingly, a need exists for an improved compensation system for a jacking frame.

SUMMARY

In one embodiment, the present invention is an offshore oil well platform assembly that includes a jacking frame, which supports a coiled tubing injector, which in turn is connected to a wellhead during a coiled tubing operation; and a compensation system. The compensation system includes a force measurement system which measures forces applied to the wellhead; a force delivery system, which provides a compensating force to counteract at least a portion of the measured forces on the wellhead; and a control system which receives signals from the force measurement system indicative of the measured forces, and operates the force delivery system based on the measured forces.

In another embodiment, the force delivery system as described above further includes at least one passive hydraulic cylinder, and at least one active hydraulic cylinder.

In yet another embodiment, the present invention is a method of use of a compensation system on a jacking frame for an offshore oil well platform assembly that includes measuring a force applied to a wellhead of the assembly; and sending a signal to a control system indicating the measured force, wherein the control system operates a force delivery system, based on the measured force, to provide a compensating force that counteracts at least a portion of the measured force.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF EMBODIMENTS OF THE INVENTION

Figure 1:
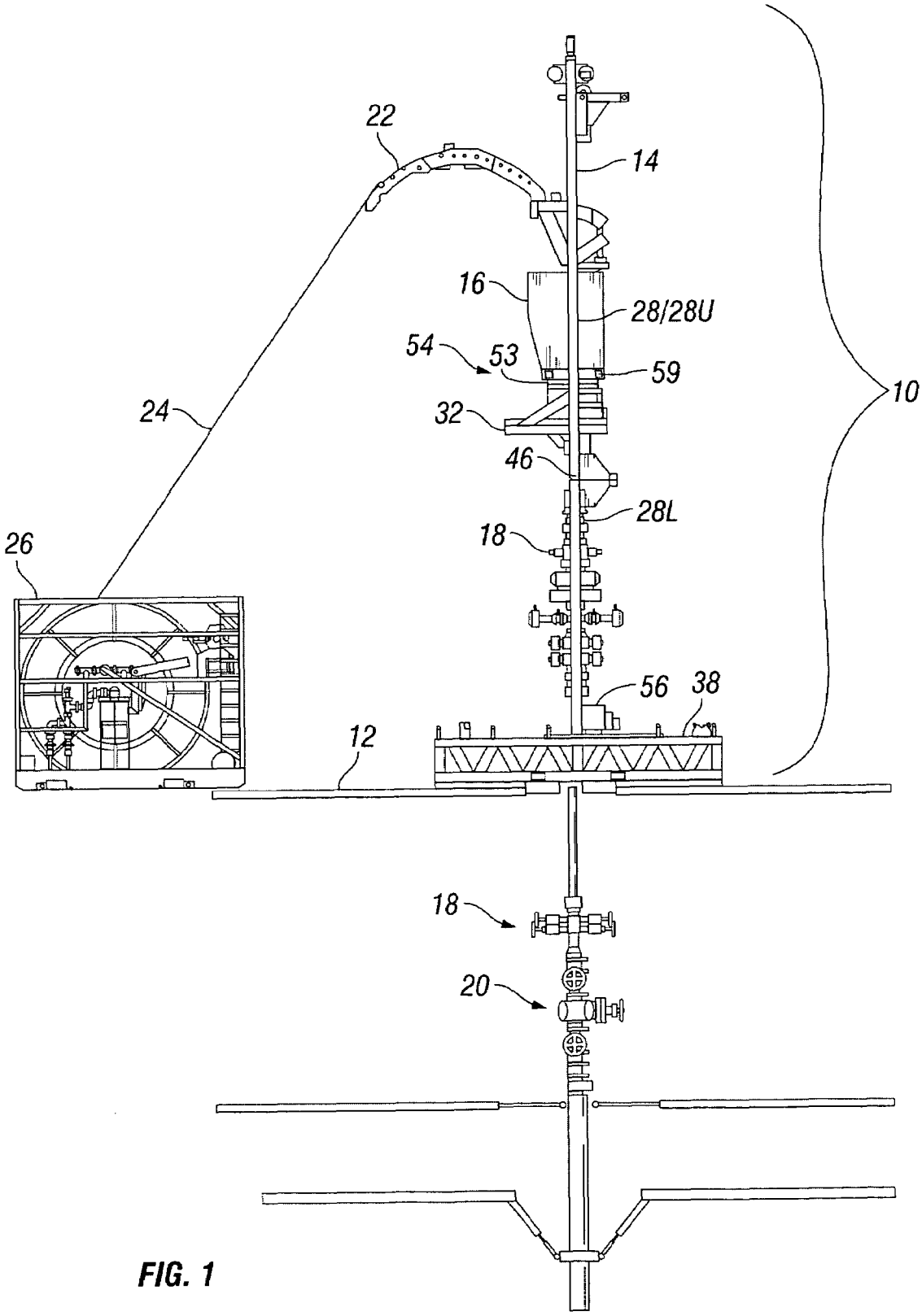
FIG. 1 is a side view of a jacking frame having a compensation system according to one embodiment of the present invention.
Figure 2:
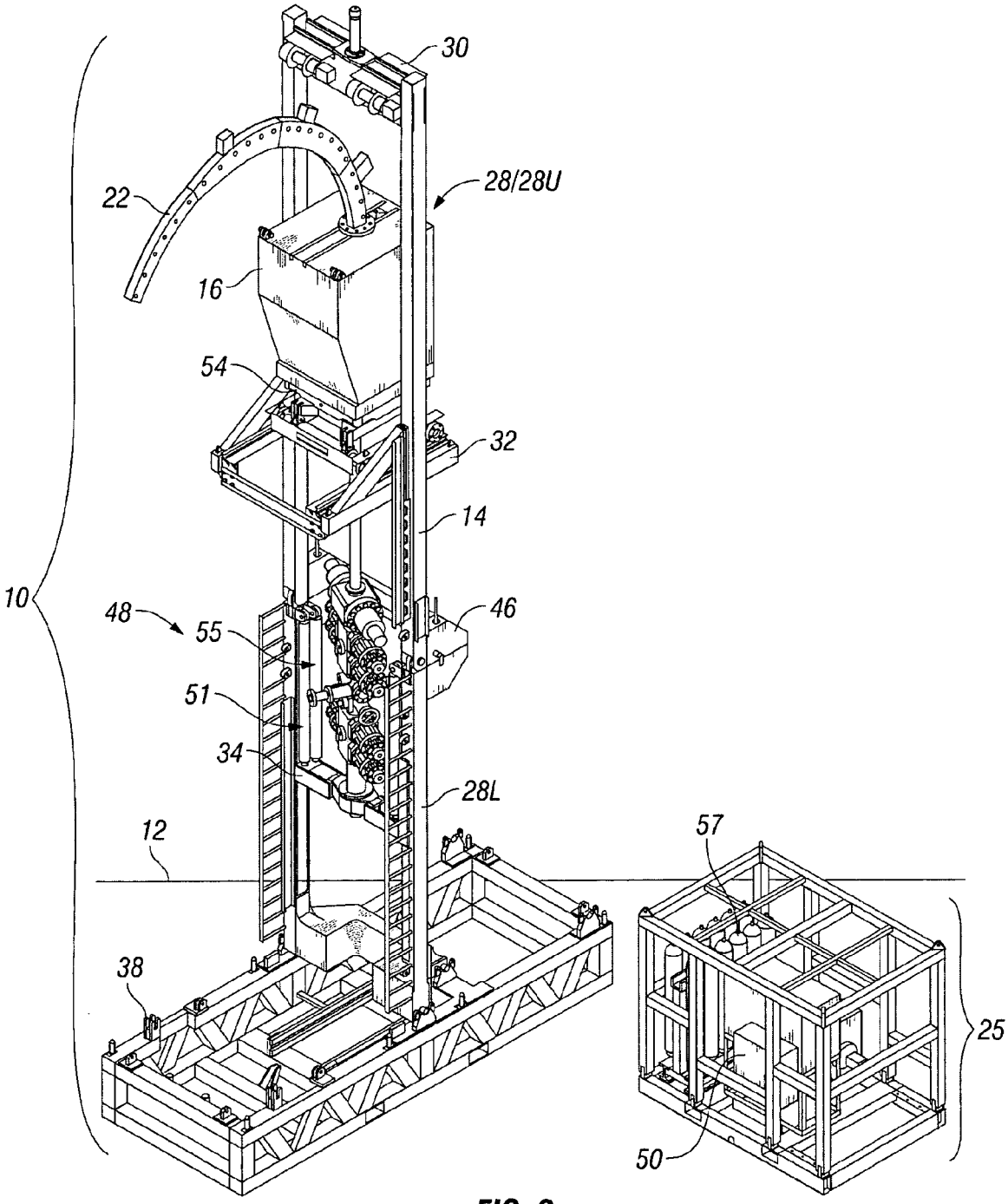
FIG. 2 shows a perspective view of the jacking frame with the compensation system of FIG. 1.
Figure 3:
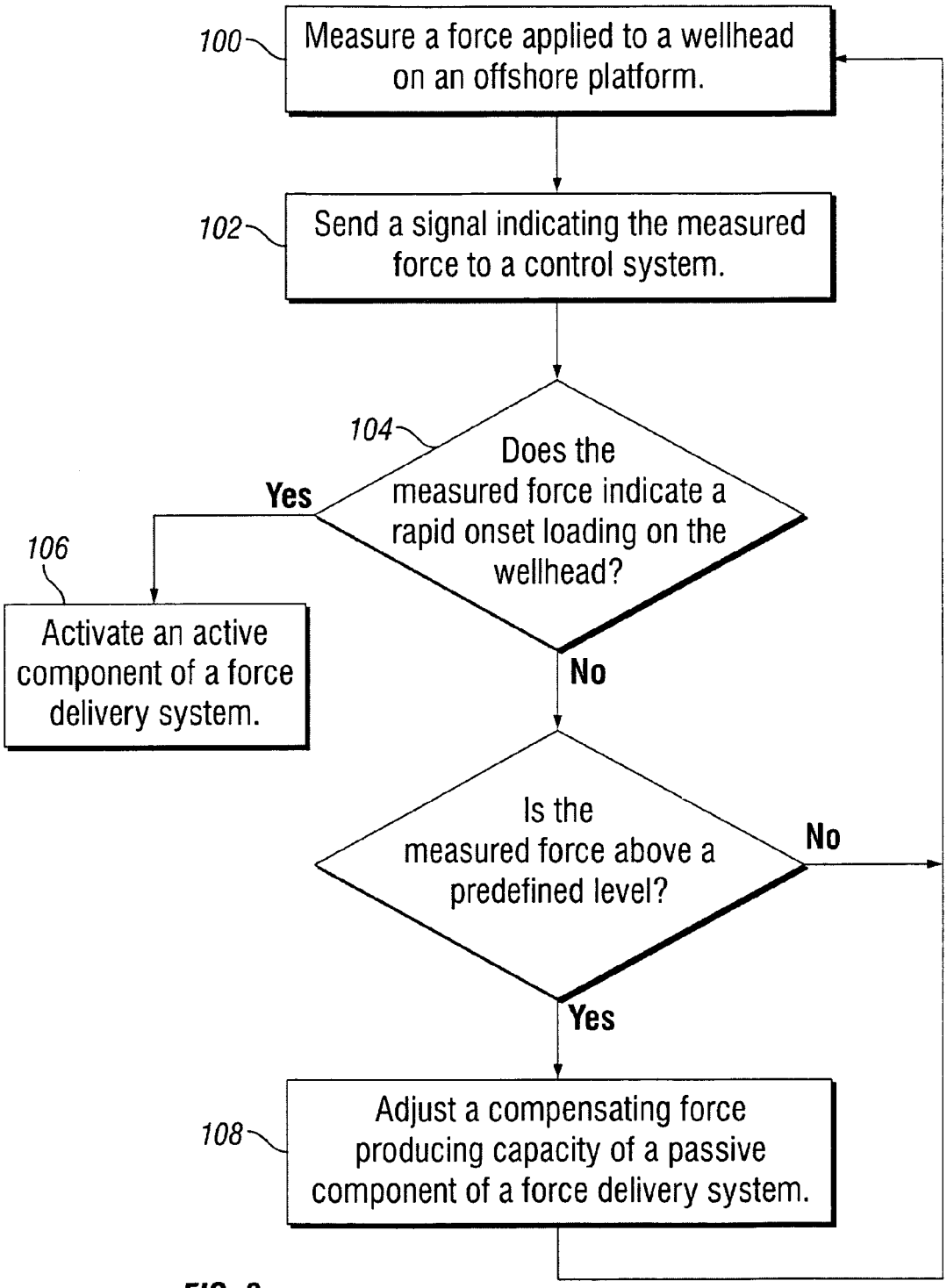
FIG. 3 shows a method of use of a compensation system according to one embodiment of the invention.

As shown in FIGS. 1-3, embodiments of the present invention are directed to a compensation system for a jacking frame. In one embodiment the compensation system includes a force measurement system, which measures the force applied to a wellhead during a coiled tubing operation. A real-time feedback signal is used to send a signal to the control system indicating the measured force. The control system analyses the measured force to determine if the force indicates rapid onset loading on the wellhead. If so, the control system activates a fast-acting force delivery system to counteract the force on the wellhead.

As such, unlike the compensation systems of the prior art, discussed above, that respond purely passively to a relative motion to maintain a relatively constant force between a coiled tubing injector and a wellhead, the compensation system of the present invention responds when an unacceptable force is applied to the wellhead and includes both a passive component and an active component.

This response capability of the inventive control system is particularly relevant to coiled tubing operations where the coiled tubing string becomes stuck while attempting to pull the string out of the wellhead, which results in the transfer of large forces from the injector to the wellhead. However, the compensation system of the present invention is applicable and responsive to any other circumstance where there is rapid onset loading or an otherwise undesirable force on the wellhead, such as that related to platform installed equipment acting on the wellhead. Thus, the compensation system of the present invention accounts for potentially detrimental force application to the wellhead that is otherwise neglected in conventional motion compensation systems, such as those described above.

FIGS. 1 and 2 show a jacking frame 10, according to one embodiment of the present invention, disposed on an offshore drilling platform 12. As shown, the jacking frame 10 includes a support structure 14, which supports a coiled tubing injector 16, as well as pressure-control equipment attached thereto, such as one or more blow out preventers 18. The blow out preventer 18, in turn, is connectable to a wellhead 20.

As shown, forming a portion of the coiled tubing injector 16 is a gooseneck 22, which guides a coiled tubing string 24 from a coiled tubing reel 26 to the coiled tubing injector 16. The injector 16 injects the coiled tubing string 24 into the wellhead 20 during a coiled tubing operation, and retrieves the coiled tubing string 24 after the operation is complete.

As shown in FIG. 2, the support structure 14 of the jacking frame 10 includes a pair of vertically extending columns or mast structures 28. In one embodiment, the frame columns 28 are connected by at least one crossbar 30. Disposed between the columns 28 is a carriage system 32 for supporting the coiled tubing injector 16, as well as a carriage system 34 for supporting the blow out preventer 18. In one embodiment, each carriage system 32 and 34 is movable relative to the frame columns 28. The compact column arrangement of the jacking frame 10 allows it to be mounted within a mast structure of a corresponding derrick for use during a coiled tubing operation. However, at the user's option, the jacking frame 10 may alternatively be mounted externally to the mast structure of the derrick.

In one embodiment, the columns 28 of the jacking frame 10 are connected to a base 38. The base 38 allows the jacking frame 10 to be a free standing assembly, supported directly by the rig platform 12. However, if desired, guidewires (not shown) may be attached between the frame columns 28 and the rig platform 12 to provide additional support for the jacking frame 10. In one embodiment, the base 38 is rectangular in shape, having a width dimension that is approximately equal to the width dimension of the remainder of the jacking frame 10. However, in other embodiments, the base 38 may have any appropriate shape and/or size. The frame base 38 may be connected to the frame columns 28 by any appropriate means. For example, in one embodiment the frame base 38 is removably attached to the frame columns 28, by threaded fastening means.

In one embodiment, the frame assembly 10 includes an upper portion that is pivotally and/or removably connected to a lower portion. For example, in the depicted embodiment of FIG. 1, each column 28 includes a joint 46 which allows the column 28, and hence the frame 10 itself, to be separated into an upper portion 28U and a lower portion 28L. Each upper and corresponding lower portion 28U and 28L are fixedly or removably connected by any one of a variety of means, such as a pin, a threaded fastener, a hinge, or another appropriate fastening means.

In one embodiment, the joint 46 between the upper and lower column portions 28U and 28L is a pivotal joint that allows the upper column portion 28U to be rotated away from the vertical relation to the lower column portion 28L that is shown in FIGS. 1 and 2. In the alternative or in addition, the upper and lower column portions 28U and 28L are removably connected, allowing the frame 10 to be disassembled into smaller components that are lighter and easier to transport than the assembled frame 10.

In one embodiment, the frame 10 also includes a compensation system 25 having a force measurement system 54, a force delivery system 48, and a control system 50 for receiving signals from the force measurement system 54 and controlling the force delivery system 48.

The force delivery system 48 counteracts a portion of the loads on the wellhead 20 that are created by the weight and/or movements of the blow out preventer 18, the coiled tubing injector 16, and/or the coiled tubing string 24. In the depicted embodiment, the force delivery system 48 is connected between at least one of the lower column portions 28U and the blow out preventer carriage 34.

Thus arranged, the force delivery system 48 is adapted to counteract at least a portion of the static weight of the blow out preventer 18 and the coiled tubing injector 16, and the static and/or dynamic weight of the coiled tubing string 24 (that is, when a portion of the coiled tubing string 24 is being added or removed from the wellhead 20, the weight of the coiled tubing string 24 is said to be dynamically changing.)

A typical capacity for such a force delivery system 48 is approximately 150,000 pounds. However, the force delivery system 48 may be designed or manufactured to counteract any load which may be encountered during a coiled tubing operation. In the embodiment of FIG. 1, the force delivery system 48 includes one or more hydraulic cylinders. However, in other embodiments, the force delivery system 48 may include a rack and pinion system, a winching system, a power screw, or another appropriate force delivery means.

In one embodiment, the force delivery system 48 includes an active component, which is responsive to rapid onset loading of the wellhead 20; and a passive component, which is responsive to both gradual load changes on the wellhead 20, such as that caused by adding or removing coiled tubing 24 from the well, and rapid onset loading of the wellhead 20.

In embodiments where the force delivery system 48 includes one of more hydraulic cylinders, the force delivery system 48 may include at least one passive hydraulic cylinder 51, which functions as the above described passive component of the force delivery system 48; and at least one active hydraulic cylinder 55, which functions as the above described active component of the force delivery system 48. Each hydraulic cylinder 51 and 55 is connected, such as by hoses (not shown) to a bank of accumulators 57.

In one embodiment, some of the accumulators 57 are connected to the passive hydraulic cylinder(s) 51 and some of the accumulators 57 are connected to the active hydraulic cylinder(s) 55. Connecting the hydraulic cylinders 51 and 55 to the accumulators 57 allows hydraulic fluid to be transferred between the hydraulic cylinders 51 and 55 and the accumulators 57. Since the volume for receiving hydraulic fluid in the accumulators 57 is much greater than the volume for receiving hydraulic fluid in the hydraulic cylinders 51 and 55, the accumulators 57 dampen the forces exerted by the hydraulic cylinders 51 and 55, allowing the hydraulic cylinders 51 and 55 to function as springs having relatively constant spring rates.

Also, since the passive and active hydraulic cylinders 51 and 55 are separately connected to the bank of accumulators 57, the accumulators that are connected to the passive hydraulic cylinder(s) 51 can be charged to a predetermined amount, and the accumulators that are connected to the active hydraulic cylinder(s) 55 can be charged to different predetermined amount. This allows the active hydraulic cylinder(s) 55 to be used only when needed to compensate for a rapid load change on the wellhead 20, and allows the passive hydraulic cylinder(s) 51 to compensate both during relatively slow load changes and to assist the active hydraulic cylinder(s) 55 during rapid onset loading on the wellhead 20.

In one embodiment, the frame 10 also includes a force measurement system 54. The force measurement system 54 may be placed anywhere on the frame 10 appropriate for measuring the force applied to the wellhead 20. For example, in the embodiment of FIGS. 1 and 2, the force measurement system 54 is located beneath the injector 16. In this embodiment, the force measurement system 54 may include any appropriate device or combination of devices for measuring the forced applied to the wellhead 20, such as an array of load cells 53, and/or load pins 59. In addition, the force measurement system 54 may include one or more pressure transducers 56 for measuring the pressure inside the hydraulic cylinders 51 and 55, and hence the compensating force exerted by the hydraulic cylinders 51 and 55. In alternative embodiments, the force measurement system 54 may include any appropriate device or combination of devices for measuring the force on the wellhead 20 and the force exerted by the hydraulic cylinders 51 and 55.

Note that in FIG. 2 the control system 50 is generically depicted as a computer, however, the control system 50 may be any appropriate device for receiving signals from the force measurement system 54, and controlling the force delivery system 48 when a predetermined force signal is received. Note also that the force measurement system 54, and the various components thereof (such as the load cells 53, load pins 59 and pressure transducer(s) 56) are schematically shown in FIG. 1.

Although the force measurement system 54 has been described and shown in specific areas of the depicted embodiments, in alternative embodiments of the invention the force measurement system 54 may be disposed on any appropriate area of the jacking frame 10 for measuring forces that are applied to the wellhead 20 and the forces that are exerted by the hydraulic cylinders 51 and 55. Similarly, although the force delivery system 48 has been described and shown in specific areas of the depicted embodiments, the force delivery system 48 may be disposed on any appropriate area of the jacking frame 10 for counteracting forces on the wellhead 20. Also, although the compensation system 25 of the present invention has been described and shown on a specific jacking frame 10, the compensation system 25 of the present invention may be used on any appropriate jacking frame.

As described above, for slow increases or decreases in the force on the wellhead 20, such as that caused by the addition or removal of coiled tubing from the well, the force is compensated by the passive hydraulic cylinder(s) 51. In such an instance, if the force is increased or decreased by a predetermined amount, the control system 50 automatically adjusts the hydraulic pressure in the accumulators 57 that are connected to the passive hydraulic cylinder(s) 51 in order to control the compensating force in the passive hydraulic cylinder(s) 51. For this purpose the bank of accumulators 57 should be sized appropriately to allow for the spring rate of the cylinder(s) 51 to be relatively constant throughout the stroke of the cylinder(s) 51.

For rapid load changes on the wellhead 20, such as that caused by the coiled tubing string 24 becoming stuck in the well, the passive hydraulic cylinder(s) 51 continue to apply a compensating force, but in addition the active hydraulic cylinder(s) 55 are activated. The active hydraulic cylinder(s) 55 provide an additional force to that provided by the passive hydraulic cylinder(s) 51 to compensate for the rapid load change to maintain the load on the wellhead 20 within a pre-set desired range. Once the coiled tubing string 24 movement is stopped, and the additional load is removed, the active hydraulic cylinder(s) 55 are deactivated. The passive hydraulic cylinder(s) 51, however, continues to support the coiled tubing at the previous force required before the occurrence of the rapid load change.

FIG. 3 shows a method of use of the compensation system 25 according to one embodiment of the invention. As shown in step 100, the force measurement system 54 measures the force applied to the wellhead 20, such as the force that is applied to the wellhead 20 during the running of coiled tubing in and out of the well. In this step 100, the force measurement system 54 may also measure the pressure in the passive hydraulic cylinder(s) 51, and hence the force exerted by the passive hydraulic cylinder(s) 51.

In step 102 a signal, such as a real-time feedback signal, is sent to the control system 50 indicating the force(s) measured by the force measurement system 54. In step 104, the control system 50 determines if the measured force(s) indicates a rapid onset loading or an otherwise undesirable force on the wellhead 20. For example, in one embodiment in step 104, the control system 50 compares the measured force applied to the wellhead 20 and the measured compensating force applied by the passive hydraulic cylinder(s) 51 to determine if a rapid onset loading or an otherwise undesirable force on the wellhead 20 exists. In step 106 if the control system 50 has detected a rapid onset loading on the wellhead 20, the control system 50 activates the active hydraulic cylinder(s) 55 to compensate the force on the wellhead 20.

In one embodiment, at step 108 if the measured force does not indicate a rapid onset load, but is above a predefined level, such as a force range of +/−10,000 pounds from a preset tensile load of 15,000 pounds, then the control system 50 automatically adjusts the hydraulic pressure in the accumulators 57 that are connected to the passive hydraulic cylinder(s) 51 in order to maintain a tensile load on the wellhead 20 within the desired range.

If the force measurement system 54 sends a signal to the control system 50 indicating a greater than 20,000 pound change in the load on the wellhead 20, which occurs in a time period of less than $1/10^{th}$ of a second, then rapid onset loading is exists and the control system 50 activates the active hydraulic cylinder(s) 55, which temporarily apply an additional 40,000 pounds of force to the force delivery system 48. This compensation force is held until the coiled tubing 24 movement is stopped and the additional load is removed. Once the load is removed the control system 50 deactivates the active hydraulic cylinder(s) 55.

The preceding description has been presented with reference to presently preferred embodiments of the invention. Persons skilled in the art and technology to which this invention pertains will appreciate that alterations and changes in the described structures and methods of operation can be practiced without meaningfully departing from the principle and scope of this invention. Accordingly, the foregoing description should not be read as pertaining only to the precise structures described and shown in the accompanying drawings, but rather should be read as consistent with and as support for the following claims, which are to have their fullest and fairest scope.

The invention claimed is:

1. An offshore wellbore platform assembly comprising:

a jacking frame;

a coiled tubing injector supported by the jacking frame;

a coiled tubing string injected into a wellbore by the coiled tubing injector;

a wellhead connected to the coiled tubing injector; and a compensation system comprising:

a force measurement system which measures forces applied to the wellhead during a coiled tubing operation, a force delivery system, which provides a compensating force to counteract at least a portion of said measured forces on the wellhead, and a control system which receives signals from the force measurement system indicative of said measured forces, and operates the force delivery system based on said measured forces.

2. The assembly of claim 1, wherein the force delivery system comprises both an active component and a passive component.

3. The assembly of claim 2, wherein the active component of the force delivery system provides at least a portion of said compensating force when said measured forces indicate a rapid onset loading of the wellhead.

4. The assembly of claim 3, wherein said measured forces indicate said rapid onset loading of the wellhead when the measured force is relatively large and occurs in a relatively short period of time.

5. The assembly of claim 3, wherein the passive component of the force delivery system continually provides at least a portion of said compensating force.

6. The assembly of claim 1, wherein the force delivery system comprises a passive component, and wherein the control system automatically adjusts a compensating force producing capacity of the passive component based on said measured forces.

7. The assembly of claim 2, wherein the passive component of the force delivery system comprises at least one passive hydraulic cylinder, and wherein the active component of the force delivery system comprises at least one active hydraulic cylinder.

8. The assembly of claim 7, further comprising a bank of accumulators, wherein each passive hydraulic cylinder is in fluid communication with a portion of the accumulators, and wherein each active hydraulic cylinder is in fluid communication with another portion of the accumulators.

9. The assembly of claim 8, wherein the control system automatically adjusts a hydraulic pressure in the accumulators that are in fluid communication with the passive hydraulic cylinders in order to control a compensating force producing capacity of the passive hydraulic cylinders based on said measured forces.

10. An offshore wellbore platform assembly comprising:

a jacking frame;

a coiled tubing injector supported by the jacking frame;

a coiled tubing string injected into a wellbore by the coiled tubing injector;

a wellhead connected to the coiled tubing injector; and a compensation system comprising:

a force measurement system which measures forces applied to the wellhead during a coiled tubing operation, a force delivery system, which provides a compensating force to counteract at least a portion of said measured forces on the wellhead, and a control system which receives signals from the force measurement system indicative of said measured forces, and operates the force delivery system based on said measured forces, wherein the force delivery system comprises at least one passive hydraulic cylinder, and at least one active hydraulic cylinder.

11. The assembly of claim 10, wherein the active hydraulic cylinders provides at least a portion of said compensating force when said measured forces indicate a rapid onset loading of the wellhead.

12. The assembly of claim 11, wherein said measured forces indicate said rapid onset loading of the wellhead when the measured force is relatively large and occurs in a relatively short period of time.

13. The assembly of claim 11, wherein the passive component of the force delivery system continually provides at least a portion of said compensating force.

14. The assembly of claim 10, wherein the control system automatically adjusts a compensating force producing capacity of the passive component based on said measured forces.

15. The assembly of claim 1, further comprising a bank of accumulators, wherein each passive hydraulic cylinder is in fluid communication with a portion of the accumulators, and wherein each active hydraulic cylinder is in fluid communication with another portion of the accumulators.

16. The assembly of claim 15, wherein the control system automatically adjusts a hydraulic pressure in the accumulators that are in fluid communication with the passive hydraulic cylinders in order to control a compensating force producing capacity of the passive hydraulic cylinders based on said measured forces.

17. A method of using a compensation system on an jacking frame for an offshore wellbore platform assembly comprising:

providing said jacking frame supported on said wellbore platform;

providing a coiled tubing injector supported by the jacking frame;

connecting the coiled tubing injector to a wellhead of a wellbore;

operating the coiled tubing injector to inject coiled tubing into the wellbore during a coiled tubing operation;

measuring a force applied to the wellhead during a coiled tubing operation; and sending a signal to a control system indicating said measured force, wherein the control system operates a force delivery system, based on said measured force, to provide a compensating force that counteracts at least a portion of the measured force.

18. The method of claim 17, further comprising providing the force delivery system with an active component and a passive component.

19. The method of claim 18, wherein the control system activates the active component of the force delivery system when said measured force indicates a rapid onset loading of the wellhead.

20. The method of claim 18, wherein the control system automatically adjusts a compensating force producing capacity of the passive component based on said measured forces.

* * * * *